United States Patent [19]

O'Neal, III

[11] 4,093,913

[45] June 6, 1978

[54] VACUUM MEASURING IONIZATION APPARATUS CONTROL

[75] Inventor: Charles D. O'Neal, III, Pepperell, Mass.

[73] Assignee: Varian Associates, Inc., Palo Alto, Calif.

[21] Appl. No.: 670,512

[22] Filed: Mar. 24, 1976

[51] Int. Cl.[2] ..... G01N 27/00

[52] U.S. Cl. ..... 324/33; 315/106

[58] Field of Search ..... 324/33; 328/8; 315/106, 315/108

[56] References Cited

U.S. PATENT DOCUMENTS 3,058,057 10/1962 Frost ..... 324/33

3,230,446 1/1966 Liben ..... 324/33

3,576,465 4/1971 Harvey ..... 315/106 X

*Primary Examiner*—Rudolph V. Rolinec

*Assistant Examiner*—Vincent J. Sunderdick

*Attorney, Agent, or Firm*—Stanley Z. Cole; Leon F. Herbert; Edward H. Berkowitz

[57] ABSTRACT

A triode ionization gauge controller employing logarithmic amplifiers develops a signal proportional to the logarithm of the ratio of an ion current to the ionizing current. Gaseous thermal conductivity is employed to reduce emission current at high pressure, thereby prolonging the life of the cathode. Complete over-pressure protection is accomplished by comparing emission current with respect to a predetermined limiting current.

9 Claims, 1 Drawing Figure

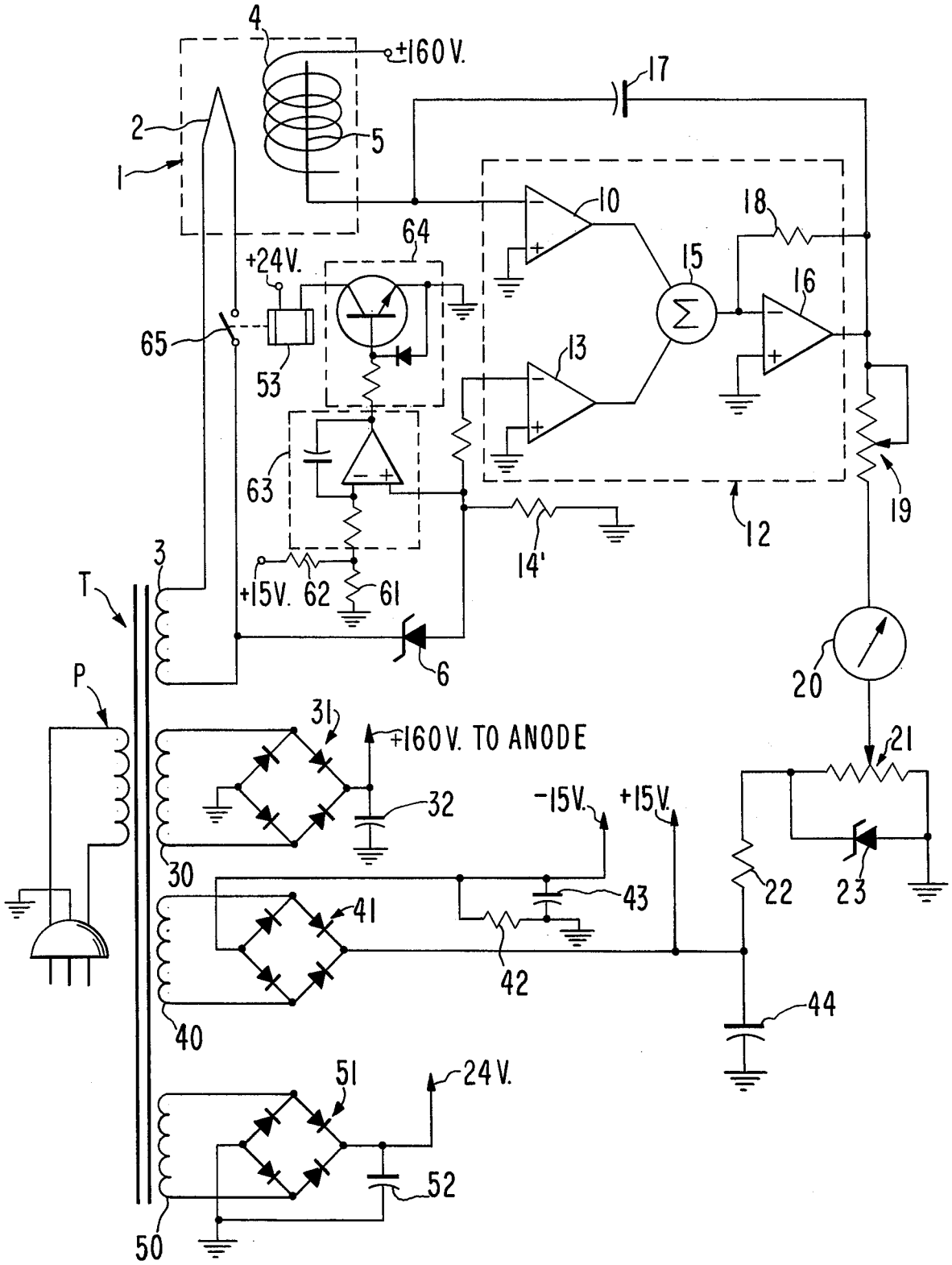
4
+160V.
17
2
5
1
10
18
64
+24V.
15
16
65
13
53
63
19
12
14'
3
T
+15V.
62
61
6
20
P
31
+160V. TO ANODE
21
32
-15V.
+15V.
30
43
22
23
41
42
44
40
51
24V.
52
50

VACUUM MEASURING IONIZATION APPARATUS CONTROL

BACKGROUND OF THE INVENTION

1. Field of the Invention

This invention relates to pressure measurement apparatus of the triode ionization gauge type which is widely employed for measuring the pressure due to residual gases in a partially evacuated vessel.

2. Description of the Prior Art

An ionization gauge consists of a gauge tube and a controller therefor. One standard triode ionization gauge tube consists of a central wire collector electrode forming the axis of a surrounding cylindrical open cage anode electrode which is maintained at a positive potential with respect to the collector. A hot-wire filament is ordinarily disposed outside of the cylindrical structure parallel to the axis thereof and maintained at a potential intermediate the grid and collector potentials. In operation, electrons emitted from the filament are accelerated toward the higher potential anode. The accelerated electrons acquire sufficient energy to ionize the residual gas and the resulting positive ions, formed at a positive potential within the cylindrical anode structure, are in turn attracted to the collector electrode at ground potential causing a positive ion current, $I_i$, to flow (through measuring apparatus) to ground. The electrons injected into the interior of the cylindrical region are ultimately collected on the anode structure causing an electron emission current, $I_e$, to flow in in the external filament-anode circuit.

Pressure measurement is realized with this apparatus because the ion current, which is readily measured, is proportional to the number of neutral atoms present (the pressure) and the number of electrons available to initiate the ionization process. The latter is proportional to the current flowing in the external anode-filament circuit. Expressed compactly $$P = k\,(I_i / I_e) \qquad \text{(Eq. 1)}$$

where P is the pressure, $I_i$ and $I_e$ are as defined above and $k$ is a proportionality constant. In the conventional prior art controller, the emission current is maintained at a constant value. Therefore, the above expression simplifies to simple linear relationship $$P = k'\,I_i \qquad \text{(Eq. 2)}$$

and pressure is obtained directly from a simple mesurement of the positive ion current and $I_e$ has become a fixed value and absorbed into the proportionality constant.

Close regulation of the emission current is required in such prior art controllers to compensate for variation in emission current which may be occasioned by a variety of factors, e.g., line voltage fluctuations or effects due to various ambient gases and the surface contamination of the emitting surfaces. Therefore, in the absence of emission current regulation, these variations in emission current would limit the degree of stability of the quantity represented as the denominator in Equation 1 with resulting lack of precision of the pressure measurement. This error is exacerbated in those ranges of very low pressure where the absolute value of emission current is substantially larger than the ion current and the magnitude of the corresponding fluctuations in emission current may approach and perhaps exceed the magnitude of the ion current.

It is also apparent that emission current must be increased with decreasing pressure, in order to provide a measurable ion current at low pressure because a smaller probability of ionization due to fewer residual gas molecules must be balanced by a greater number of ionizing electrons. The conventional prior art controller circuit requires the stabilization of the emission current at a number of different values in order to maintain a calibrated response over a desired pressure range. It is thus necessary, with such prior art controllers, to divide the broad dynamic range of such an instrument into several pre-selected sub-ranges, usually chosen for convenience to correspond to decades of the measured quantity. For each sub-range or decade, the emission current is stabilized at a corresponding value required to give measurable ion current.

Such prior art controller circuits undertake to protect the gauge tube from exposure to overpressure conditions by various means. Usually this protection takes the form of de-energizing a relay to turn off the emission current to the gauge tube filament when the pressure exceeds a predetermined level. The sensing of this level is ordinarily accomplished independently by a separate gauge, e.g., a thermocouple gauge or the like. Practical problems attend sensing the protection level with the pressure proportional output of the ionization gauge itself although this approach is sometimes attempted. The problem is that sensing pressure as a function of the collector ion current is deceptive at higher pressure because there is a double valued response of ion current to pressure. In other words, ion current goes down with decreasing pressure at low pressures and goes down with increasing pressure at high pressures. In the limit of high pressure, for example above about 100 microns, recombination processes become prevalent and the ions produced within the grid structure are subject to these processes with a probability which increases with increasing pressure. More specifically, gas atoms which become ionized and should be counted as ion current are instead neutralized by recombination with electrons and thus do not reach the collector. As a result, the ion current is a decreasing function of pressure in this pressure region. Thus at high pressure, the conventional arrangement indicates that the pressure is decreasing and there is no apparent need to turn the gauge off.

In addition to such conventional controller circuits which have been widely used in industry, proposals have been made to measure the ratio of ion current over emission current in order to give a pressure measurement which would not require the conventional precise stabilization of emission current at a fixed constant value. However, these proposals have involved some type of control over the emission current, and they do not provide any means to indicate overpressure in a manner which avoids the inaccuracy caused by the recombination phenomenon at high pressures.

SUMMARY OF THE PRESENT INVENTION

The present invention achieves an advance over the prior art by completely dispensing with the regulation of emission current. The proportionality of pressure to the ratio of ion current to emission current is implemented by sensing each of these currents. Appropriate signal processing is employed to compute the logarithmic ratio of these currents which is conveniently obtained as the difference of their respective logarithms.

The design of this controller also recognizes the importance of thermal conductivity of the residual gases for varying the filament temperature and thus its emission rate at a given voltage input. It is well known that electron emission from a hot cathode filament varies as a direct function of the filament temperature. More specifically, as the pressure goes up the cooling rate goes up and emission goes down. This causes lower filament temperature automatically at high pressure in inverse single-valued dependence upon pressure over ranges of pressure and emission sufficient for ionization gauge operation. The present invention incorporates the thermal response of ion gauge emission as part of the pressure measurement process. More specifically, if one does not artificially vary the heating power into the filament or the voltage difference between the filament and the anode, the emission current will automatically vary in inverse relation to the pressure. This provides several benefits. One is that the gauge can operate over a large range of pressures without changing ion current amplification for different pressure ranges and without requiring circuitry to shift the electron emission to different fixed rates at pressure extremes. In other words if the filament heating power and filament-anode voltage is selected to give ample electron emission at the lowest pressure the gauge is designed to measure, the cooling phenomenon will automatically reduce the emission rate at higher pressures. Since higher pressures involve a greater concentration of gas atoms, fewer electrons are required to provide ionization, and if the ratio of ion and emission current is measured the ratio reading will give an accurate representation over the full pressure range. This approach also lengthens gauge tube life as compared to a system in which emission is forced to remain constant. More specifically, in the latter system the filament must be driven harder at high pressure to overcome the cooling effect of high pressure. A further benefit of the cooling phenomenon is that if the emission current is not artificially controlled it will vary as a direct function of pressure. In other words, as the pressure increases the emission current continually decreases. It is important to note that this is a single-valued relation as distinguished from the double-value relation between ion current and pressure. In other words, the recombination effect which causes ion current to reverse its relation to pressure when the pressure increases into the recombination area does not apply to the emission current. In accordance with the invention this benefit permits accurate signaling of overpressure. More specifically, if the emission current decreases to levels previously calibrated with undesirably high pressure, it is known with certainty that such high pressure has been reached. This provides a self protection feature for the gauge tube at overpressures. In contrast, when the signal employed to indicate overpressure involves ion current output, the signal will appear to indicate decreasing pressure in the recombination area when in fact the pressure is increasing. The full benefits of this phenomenon can only be realized if the emission current is not artificially controlled.

The benefits accruing to an ionization gauge controller circuit of the present design are both economical and technical in nature. Elimination of power supply regulation requirements simplifies the circuit and reduces cost, size, weight and power dissipation. By utilizing the temperature dependence of emission of given dynamic range of operation for pressure measurement can be achieved with a dynamic range in ion current processing which is less than the equivalent in pressure. This is due to the pressure related temperature dependence of emission current which is separately processed and is found in the present work to span a dynamic range of about 1 to 1½ decades. Consequently, the dynamic range for ion current need only span a range of 3½ to 4 decades in order for the corresponding ratio of ion current to emission current to span a range of 5 decades. These narrower dynamic ranges for the component variable permit a more accurate response function for their respective processing circuits. Thus, where logarithmic amplifiers are employed, that particular 1½ decade portion of the amplifier transfer function which deviates the least from true logarithmic shape may be selected for use with emission current. Similarly, only the most accurately logarithmic 3½ to 4 decade portion of another logarithmic amplifier transfer function need be selected to process the ion current. As a result of the greater accuracy achievable in processing emission current and ion current, the ratio can more accurately represent pressure.

It is an object of the present invention to remove the necessity of regulating the accelerating voltage between the filament and anode of a triode ionization gauge tube.

It is a further object to remove the necessity of regulating the heating voltage applied to the filament of a triode ionization gauge tube.

It is an object to remove the necessity of regulating the emission current which produces the ionization of residual gases in a triode ionization gauge tube.

It is a further object of this invention to reduce the power consumption and heat dissipation of an ionization gauge controller.

It is another object of the instant invention to maintain a more nearly constant pressure sensitivity in the high pressure region of operation by automatically compensating emission current through its temperature dependence on pressure.

It is again a further object of the instant invention to increase the lifetime of the ionization gauge tube filament.

It is still another object of the present invention to increase the precision of pressure reading capability for ionization gauges over a given dynamic range by processing ion current and emission current over narrower dynamic ranges.

It is again an object of this invention to eliminate the effect upon pressure measurements of fluctuation in line voltage over rather wide limits.

It is also an object of this invention to accomplish positive protection of the gauge tube by directly comparing the emission current to a selected limiting magnitude.

BRIEF DESCRIPTION OF THE DRAWING

The single FIGURE drawing is a schematic diagram of the ionization gauge of the present invention.

DETAILED DESCRIPTION OF THE INVENTION

The ionization gauge tube 1 is a conventional hot cathode triode ionization gauge, as for example Varian Model No. 564. The electron emissive filament or cathode 2 is supplied from secondary winding 3 of transformer T. A signal derived from this winding provides a measure of the emission current drawn from the filament.

The cylindrical grid type anode structure 4 is maintained at a positive potential as for example +160 volts with respect to ground. Filament 2 is at potential, for example about 30V, intermediate the anode 4 and a collector 5 at ground potential. Collector 5 is a wire electrode centrally located within the anode cage 4. Emission current flows in the filament-anode circuit due to electrons from filament 2 passing through a potential difference of about 130 volts toward the more positive anode 4. Zener diode 6 is included in the filament-anode circuit to stabilize the emitter potential at about 30 volts. Due to the highly transparent structure of the anode most of the electrons enter the interior of this structure. Positive ions formed by electron collisions within the bounds of this region are attracted to the lower (more negative potential collector electrode 5. Positive ion current, proportional to pressure, is derived from the gauge tube collector 5 and is directed to logarithmic amplifier 10 (numerator) of a logarithmic ratio computing circuit 12, such as for example ANALOG DEVICES type 756. The second input, to logarithmic amplifier 13 (denominator) is obtained from the emission current by means of the combination of resistance divider network 14–14'. The logarithmic ratio circuit 12 develops for each input independently, an output which is equal to the logarithm of the respective input, subtracts the respective logarithmic outputs by means of internal summing amplifier 15 and amplifies the difference through internal operational amplifier 16 to provide sufficient output drive in the form of a ratio of ion current over emission current. Capacitor 17, is of sufficient capacity, for example 0.001 μf, to suppress oscillation and noise. A resistance 18, here chosen 15KΩ, determines the scale of the output to volt-decade. Variable resistance 19, typically 100KΩ, establishes the full scale deflection of the meter 20 which gives the indication of pressure in the gauge tube. Variable resistance 21, typically 5KΩ, the 1.2KΩ resistor 22 and Zener diode 23 establish the zero of the meter referenced to the constant voltage drop across the Zener diode 23.

Secondary winding 30 and conventional bridge rectifier network 31 provide +160 volts dc for application to the anode 4 of the ionization gauge 1. Capacitor 32 provides an ac path to ground for the ripple component of this voltage.

Secondary winding 40 (in combination with conventional bridge rectifier network 41, resistor 42 and capacitors 43 and 44) provides positive and negative 15 volts dc required by the log ratio computing circuit 12, and for over-pressure protection reference at a resistor 62 to be described hereinafter in more detail.

Secondary winding 50 in combination with conventional bridge rectifier 51 and output capacitor 52 supply +24V for energizing gauge tube protection relay 53 and for operation of various indicator lights (not shown).

Protection of the gauge tube is accomplished by comparing a current drawn from the junction of resistance divider 14–14' proportional to emission current with a reference current source derived from +15 volts applied through resistive divider 61–62. Comparator 63 produces an output upon the condition that the constant reference current signal exceeds the variable emission current signal. The output of the comparator biases transistor switch 64, de-exciting relay 53 by interrupting the +24 volts applied thereto, thus causing relay switch 65 to move to its open position as shown in the drawing, and shutting off the cathode 2 of the gauge tube. In the specific preferred embodiment the reference signal is chosen to correspond to 15 μA.

In operation, the emission current is reduced upon an increase in pressure in response to the increased thermal conductance concomitant with the higher pressure. The increase in heat transport away from the filament by the gas results in lower emission current due to lower filament temperature. This results from the well known thermal dependence of thermionic emission upon the temperature. It has been found that the heater design of certain commercially available triode ionization gauge tubes such as Varian models 563, 564, and 571 are close to optimum for the desired thermal emission response over the pressure range of the invention. The range of emission current variation realized through this mechanism is found to be on the order of a factor of 10 to 50, that is, 1 to 1½ decades. In addition to eliminating the requirement for emission current regulation circuitry, this variation in emission current permits a narrower dynamic range in emission current processing by each of amplifiers 10 and 13 while yet maintaining the desired dynamic range in pressure response. For example, to achieve a 5 decade span of useful pressure measurement, a conventional regulated emission current controller must process a span of ion current extending over 5 decades; the controller of the present invention need only span 3½ to 4 decades of ion current in order to yield the same 5 decade range of pressure when the gas thermal conductivity principle is employed to vary the emission current over 1 to 1½ decades.

The controller circuit of the present invention may also be employed in other pressure measurement apparatus characterized by a hot cathode emitter, an anode and an ion collector. The circuit shown in the drawing is illustrative of the class of circuits which may be employed to realize the principles of the present invention. Other embodiments may occur to those skilled in the art. No limitations upon the present invention are intended except as defined by the scope of the appended claims.

What is claimed is:

1. A controller for a pressure measuring device having a hot cathode, an anode and an ion collector, said controller comprising:

first means for providing an output signal representative of the ion current through the collector;

second means for providing an output signal representative of the electron emission current from the cathode;

means for combining the outputs of said first and second means to provide a representation of a ratio of said outputs;

indicator means responsive to said ratio to give an indication of pressure in the pressure measuring device;

circuit means to energize the cathode to generate emission current, said emission current being responsive to the temperature variation of the cathode with variation of pressure in the device; and said energizing circuit means being constructed to prevent variation in the emission current in response to variation in ion current and to prevent variation in the emission current by operator control.

2. The controller circuit of claim 1 wherein said first means and second means each comprises a logarithmic amplifier.

3. The controller circuit of claim 2 wherein said means for combining the outputs of said first and second means comprises differencing means whereby a representation of the difference in magnitude of the logarithm of ion current and the logarithm of the emission current is derived.

4. The combination of a hot cathode triode ionization gauge tube and controller circuit for said gauge tube comprising:

a hot cathode triode ionization gauge tube including a cathode, an anode and a collector;

first logarithmic amplifier means responsive to a current signal derived from said collector whereby there is obtained a signal representative of the logarithm of said collector current, said collector current being proportional to the density of molecules in said gauge tube;

second logarithmic amplifier means operative upon a current signal representative of the emission current of said gauge tube whereby there is obtained a signal representative of the logarithm of said emission current;

differencing means for combining the outputs of each said logarithmic amplifier means, deriving the difference thereof;

circuit means to permit variation of emission current in response to the temperature of said cathode;

indicator means responsive to said difference; and means to signal the existence of emission current which is below a predetermined value.

5. The method of measuring pressure with a pressure measuring device having a hot cathode, an anode and an ion collector, said method comprising:

supplying a current to heat said cathode, the emission of said cathode bearing a direct relationship to the temperature of said cathode;

the temperature of said cathode being determined by the rate at which thermal energy is removed therefrom by gases in said device, whereby a pressure related source of electrons is obtained;

applying a positive potential to said anode structure whereby electrons are accelerated to said anode producing ionization of gas in said device;

collecting ion current from said collector which receives ions formed by said electrons;

forming a function of the ion current and the electron current; and indicating the value of said function while continuously refraining from altering the value of said voltage applied to the anode.

6. The method of claim 5 wherein said function is the logarithm of the ratio of ion current to emission current.

7. The method of claim 5 wherein the step of forming said function further comprises multiplying said function by a calibration coefficient.

8. The method of protecting the cathode of a pressure measuring device having a hot cathode, an anode and an ion collector, comprising the steps of:

permitting the magnitude of emission current drawn from said cathode to vary in response to the temperature of said hot cathode;

sensing the magnitude of emission current supplied to said cathode;

comparing the magnitude of emission current to a preselected current whereby a signal is generated upon the decrease of said emission current below a preselected current, and signalling for interruption of said emission current upon occurrence of said signal.

9. A controller for a pressure measuring device, said device having a hot cathode, an anode and an ion collector, said controller comprising:

first means for providing an output signal representative of the ion current through the collector;

second means for providing an output signal representative of the electron emission current from the cathode;

means for combining the outputs of said first and second means to provide a representation of a ratio of said outputs;

indicator means responsive to said ratio to give an indication of pressure in the pressure measuring device;

circuit means to energize the cathode to generate emission current, said emission current being responsive to the temperature variation of the cathode with variation of pressure in the device, said circuit means including means to interrupt the emission current when the emission current falls below a predetermined value; and said energizing circuit means being constructed to prevent variation in the emission current in response to variation in ion current and to prevent variation in the emission current by operator control.

* * * * *